United States Patent [19]

Tanzawa et al.

[11] Patent Number: 4,862,212

[45] Date of Patent: Aug. 29, 1989

[54] IMAGE FORMING APPARATUS

[75] Inventors: Misao Tanzawa, Kawasaki; Koji Sakamoto; Mitsuru Satoh, both of Tokyo, all of Japan

[73] Assignee: Ricoh Company, Ltd., Tokyo, Japan

[21] Appl. No.: 163,027

[22] Filed: Mar. 2, 1988

[30] Foreign Application Priority Data

Mar. 3, 1987 [JP] Japan ..... 62-30914
Mar. 3, 1987 [JP] Japan ..... 62-30915

[51] Int. Cl.[4] ..... G03G 15/00; G03G 21/00

[52] U.S. Cl. ..... 355; 355/260; 355/296

[58] Field of Search ..... 355/3 R, 3 D D, 3 BE, 355/15

[56] References Cited

U.S. PATENT DOCUMENTS

| | | | |
|---|---|---|---|
| 3,671,119 | 6/1972 | Engel et al. | 355/3 DR |
| 4,376,577 | 3/1983 | Okamoto | 355/3 DR |
| 4,460,267 | 7/1984 | Ogawa | 355/3 DD |
| 4,583,844 | 4/1986 | Honda | 355/3 DR X |
| 4,760,424 | 7/1988 | Ohba et al. | 355/3 R |

FOREIGN PATENT DOCUMENTS 59126251 of 0000 Japan .

*Primary Examiner*—Fred L. Braun
*Attorney, Agent, or Firm*—Oblon, Spivak, McClelland, Maier & Neustadt

[57] ABSTRACT

An image forming apparatus allows an image carrier, a developing unit and a cleaning device each having a different service life to be detachably mounted in a housing thereof. The developing and cleaning devices are rotatably supported to constitute an image forming unit. The image forming unit is detachably supported by a first rotatable body which is mounted to the apparatus housing. The image carrier is detachably supported by opposite side plates of the apparatus housing or by a second rotatable body which is supported by the apparatus housing to be rotatable independently of the first rotatable body. A positioning arrangement is provided for controlling the rotation of the developing and cleaning devices so that the image forming unit and the image carrier may be prevented from interfering with each other when the unit is moved toward and away from the image carrier.

7 Claims, 14 Drawing Sheets

IMAGE FORMING APPARATUS

BACKGROUND OF THE INVENTION

The present invention relates to an image forming apparatus of the type developing an electrostatic latent image provided on an image carrier by toner which is supplied from a developing device, transferring the resulting toner image to a transferring material, and removing toner remaining on the image carrier after the transfer of toner image by a cleaning device.

An image forming apparatus of the type described is well known in the art in relation to a printer, a facsimile apparatus, and other equipment. It has been proposed to construct the image carrier, developing device and cleaning device into a unit which is detachable from the housing of the image forming apparatus. With such a unit, one can replace the image carrier, developing device and cleaning device with new ones when the life of any of them expires or replace the developing device which another which contains toner of a different color so as to change the color of development. Usually, the life of a developing device is understood to expire when, for example, the casing of the device storing toner therein becomes empty or almost empty, and that of a cleaning device is understood to expire when, for example, the casing of the device in which toner is collected becomes full or almost full.

In parallel with the recent progress of technology, the life of an image carrier which may be implemented with a photoconductive element by way of example is becoming longer than those of a developing device and cleaning device. In this situation, constructing the image carrier, developing device and cleaning device into a unit which may be discarded when the life of any one of them expires as previously stated brings about some problems from the cost standpoint. Specifically, when the life of the developing device or that of the cleaning device expires, the whole unit including the image carrier which is still usable has to be discarded. Conversely, when the image carrier is scratched or otherwise damaged by unexpected objects or while a trouble caused by a transferring material being transported is dealt with, it has to be disposed of together with the developing device and cleaning device which are still usable. In the case that a plurality of developing devices each containing toner of a different color are prepared to be selectively used, the same number of image carriers as the developing devices have to be used resulting in a prohibitive total cost. Furthermore, when the image carrier is implemented with a photoconductive element, it is necessary for all the openings of the unit to be shielded from light so that the image carrier may be prevented from being affected by light when the unit is removed from the housing of the apparatus. This adds to the production cost of such a unit.

Although image forming apparatuses designed to solve the above problems have been proposed as disclosed in, for example, Japanese Laid-Open Patent Publication (Kokai) No. 61-110168 (Canon), they are not fully satisfactory.

SUMMARY OF THE INVENTION

It is, therefore, an object of the present invention to eliminate the drawbacks particular to the prior art image forming apparatus of the type using an image carrier, a developing device and a cleaning device which have different service lives and which are constructed as a unit unitarily removable from the housing of the apparatus.

It is another object of the present invention to enhance the economy of the above-described type of image forming apparatus by allowing each of the image carrier, developing device and cleaning device to be used to the end of its usable life.

It is another object of the present invention to provide an image forming apparatus in which an image forming unit made up of a developing device and a cleaning device and detachable from the housing of the apparatus is prevented from interfering with an image carrier when the unit is loaded into and unloaded from the apparatus housing.

It is another object of the present invention to provide an image forming apparatus having an image carrier, a developing device and a cleaning device which are detachable from the apparatus housing independently of each other and are capable of easily dealing with troubles such as a jam caused by a transferring material.

It is another object of the present invention to provide a generally improved image forming apparatus.

In accordance with the present invention, in an image forming apparatus having at least an image carrier for carrying an electrostatic latent image thereon, a developing device for developing the latent image to produce a visible image, and a cleaning device for removing a developer which remains on the image carrier after the transfer of the visible image, there are provided in combination an image forming unit constituted by the developing and cleaning devices which are individually rotatable about pivotal supporting means, a unit rotatable body rotatably supported by a housing of the image forming apparatus and detachably supporting the image forming unit, and a positioning means for positively rotating the developing and cleaning devices relative to one another, and more particularly for positioning the image forming unit relative to the image carrier, when the unit rotatable body is rotated between an operative and an inoperative position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described in detail with reference to the accompanying drawings. While the following description is directed to an electrophotographic copier, it will be apparent that the present invention is similarly applicable to a facsimile machine, a printer and other equipment as well.

First Embodiment

Figure 1:
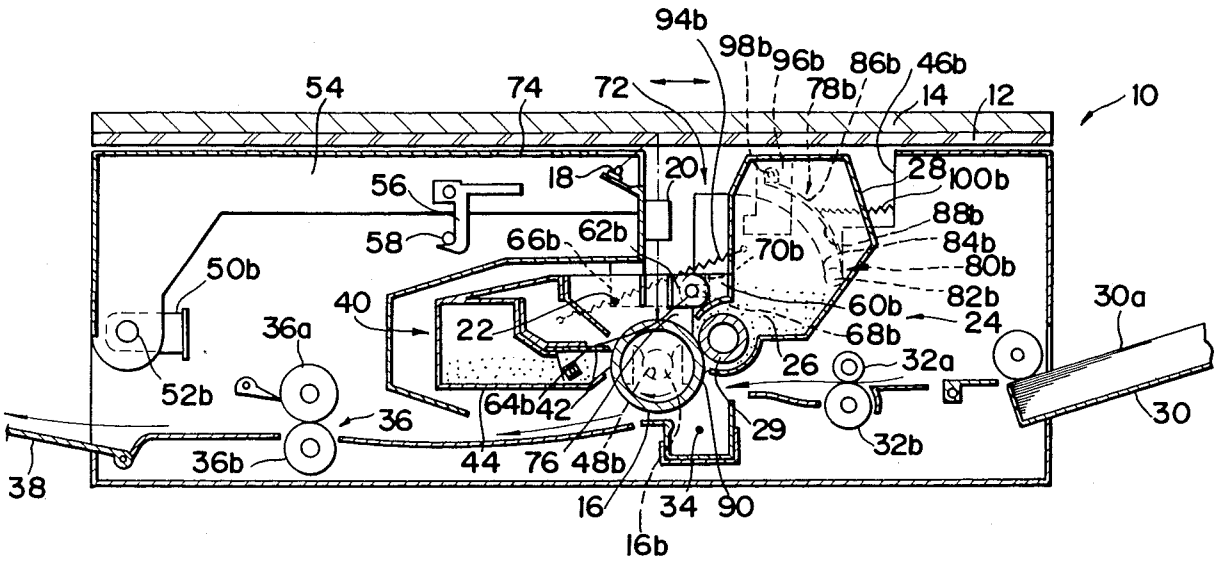
FIG. 1 is vertical section of an electrophotographic copier which is taken along its center and is representative of a first embodiment of the present invention.

Referring to FIG. 1, an electrophotographic copier 10 which is representative of a first embodiment of the present invention includes a glass platen 12. The glass platen 12 is located in an upper portion of the housing of the copier 10 and is movable horizontally in a reciprocal motion. Hereinafter, the housing of the copier 10 will be simply referred to as the copier housing. An original document, not shown, is laid on the glass platen 12 and pressed from above by a presser plate 14. A photoconductive element 16 in the form of a drum is rotatably disposed in the copier housing to serve as an image carrier. In operation, the glass platen 12 and the presser plate 14 are moved in the horizontal direction as indicated by an arrow in the figure while, at the same time, a light source 18 is turned on to illuminate the document on the glass platen 12. Light reflected by the document is propagated through a condensing light-transmitting element 20 to become incident to the surface of the drum 16, which is rotating counterclockwise as viewed in the figure. Since the surface of the drum 16 has been electrostatically charged beforehand with a predetermined polarity by a charger 22, a latent image associated with the document is formed on the drum surface which is exposed imagewise as stated above. When the latent image is moved past a developing device 24, it is developed by toner 26 to become a toner image. The developing device 24 includes a casing 28 in which the toner 26 is stored, and a developing roller 29 which transports the toner 26 toward the drum surface by carrying it on its periphery. The toner 26 is electrostatically transferred from the developing roller 29 to the drum 16 to develop the latent image. If desired, use may be made of a two-component developer which is a mixture of toner and carrier. The casing 28 of the developing device 24 will hereinafter be simply referred to as the developing casing 28.

A transferring material 30*a* in the form of paper sheets is fed from a paper cassette 30 toward register rollers 32*a* and 32*b*, the paper cassette 30 being detachably mounted in the housing of the copier 10. At a predetermined appropriate time, the paper sheet 30*a* is driven by the register rollers 32*a* and 32b through a space between the surface of the drum 16 and the transfer charger 34 so that the toner image may be transferred from the drum 16 to the paper sheet 30*a*. Then, the paper sheet 30*a* is moved through a fixing device 36 which is made up of fixing rollers 36*a* and 36*b*, whereby the toner image on the paper sheet 30*a* is fixed. Subsequently, the paper sheet 30*a* is fed out of the copier housing to a tray 38. The toner remaining on the drum 16 after the transfer of the toner image is removed by a cleaning member of a cleaning device 40 which, in the illustrative embodiment, is implemented with a cleaning blade 42 which makes contact with the drum 16. The toner collected in this manner is retained in the casing 44 of the cleaning device 40. The casing 44 will hereinafter be referred to as the cleaning casing 44.

Figure 2:
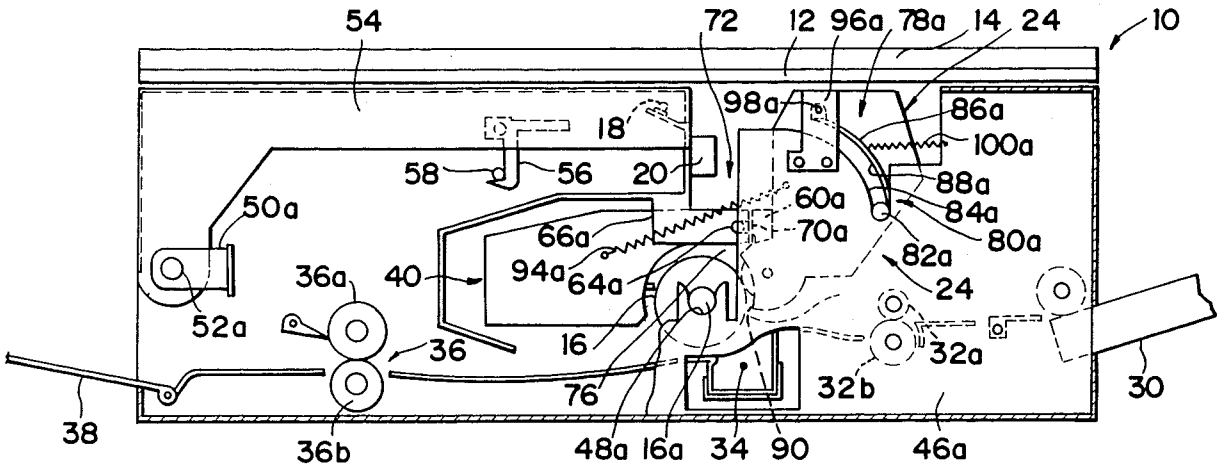
FIG. 2 is a section of the copier of FIG. 1 taken at a position in front of a side panel which is located at the front side of the copier.
Figure 3:
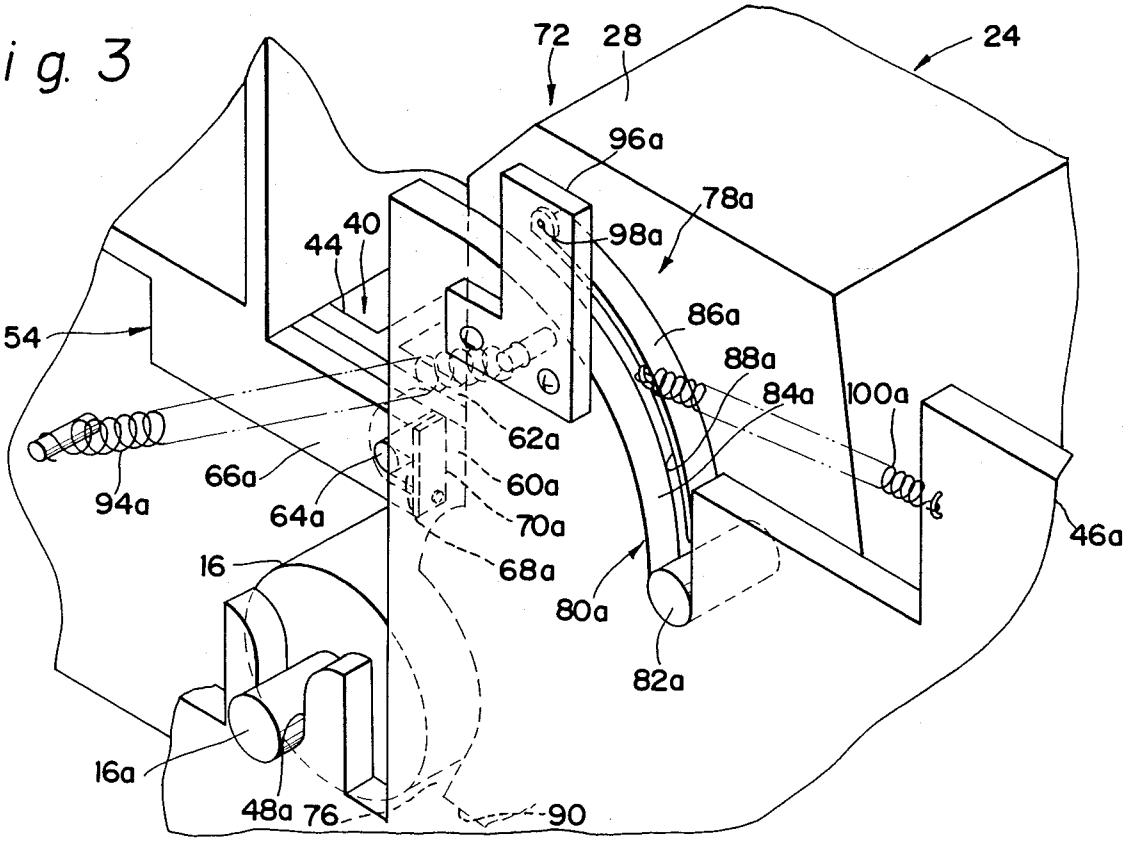
FIG. 3 is a perspective detail of guide structure shown in FIG. 2.

The copier 10 is generally similar in construction to an ordinary electrophotographic copier. In this particular embodiment, the drum 16 is rotatably received in recesses 48*a* and 48*b* of a pair of side plates 46*a* and 46*b* which are spaced at a distance from each other at, respectively, the front and the rear of the copier housing, as also shown in FIGS. 2 and 3. Here and in the following description, let the "front" and the "rear" be, respectively, the front side and the back side parallel to the plane of the sheets of FIGS. 1 and 2. A rotatable body 54 is rotatably supported by the side plates 46*a* and 46*b* via brackets 50*a* and 50*b* and pins 52*a* and 52*b*, respectively. As shown in FIGS. 1 and 2, the rotatable body 54 is usually held in a closed position below the glass platen 12. In such a closed position, a lock lever 56 which is pivotally connected to the body 54 is engaged with a lock pin 58 which is studded on one of the side plates 46*b*.

A pair of ears 60*a* and 60*b* and a pair of ears 62*a* and 62*b*, FIG. 3, protrude from the developing casing 28 and the cleaning casing 44, respectively. Support pins 64*a* and 64*b* are fixed on the developing casing 28 and rotatably engaged with the ears 60*a* and 62*a* and the ears 60*b* and 62*b*, respectively. In this construction, the developing device 24 and the cleaning device 40 are rotatably connected relative to each other via the support pins 64*a* and 64*b*. The support pins 64*a* and 64*b* are rotatably received in and supported by, respectively, recesses 68*a* and 68*b* which are formed in ears 66*a* and 66*b* of the rotatable body 54. Latches 70*a* and 70*b* which are either rotatable or removable are adapted to prevent the support pins 64*a* and 64*b* from slipping out of their associated recesses 68*a* and 68*b*, respectively.

As stated above, the developing device 24 and the cleaning device 40 constitute an image forming unit 72 which is retained by the rotatable body 54 via the support pins 64*a* and 64*b*. In addition, the cleaning device 40 is rotatably retained by the body 54 through other members, not shown, to be thereby safeguarded against shaking. In the illustrative embodiment, the light source 18 and light-transmitting element 20 are fixed to the rotatable body 54 while the charger 22 is provided in the cleaning casing 44. Hence, the charger 22 also constitutes a part of the image forming unit 72. As shown it the figures, other various image forming elements are arranged in the copier housing.

Figure 4:
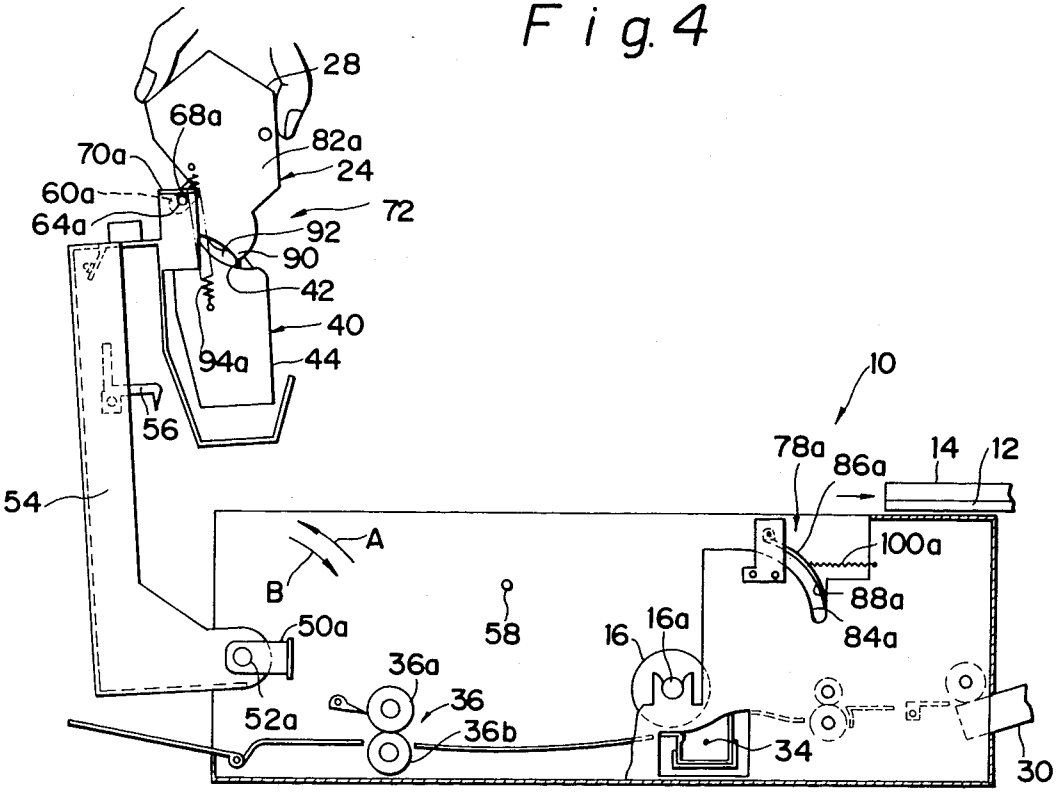
FIG. 4 is a view similar to FIG. 2, showing the copier with a rotatable body raised to its open position.

To replace the developing device 24 or the cleaning device 40 whose life has expired or to replace the device 24 with another which stores toner of a different color, the glass platen 12 is retracted to the right together with the presser plate 14, as shown in FIG. 4. Then, the operator's fingers are inserted in an opening 74, FIG. 1, which is formed through the upper wall of the rotatable body 54, so as to rotate the lock lever 56 counterclockwise until the lock lever 56 becomes released from the lock pin 58. In this condition, the rotatable body 54 is raised rotating counterclockwise (arrow A) about the pins 52*a* and 52*b*. Upon reaching an open, inoperative position shown in FIG. 4, the body 54 is fixed in place by a stop, not shown. In this inoperative position, the center of gravity of the rotatable body 54 and image forming unit 72 is located at the left of the pins 52*a* and 52*b* as viewed in FIG. 4, and so the body 54 is stably maintained in the position of FIG. 4 even if the operator's hand is removed from the body 54.

On the other hand, the drum 16 remains in the copier housing supported by the side plates 46*a* and 46*b* of the copier housing. Hence, the image forming unit 72 is located in an inoperative position above the copier housing while being spaced far apart from the drum 16. In this condition, by rotating or removing the latches 70*a* and 70*b*, the support pins 64*a* and 64*b* may be removed from their associated recesses 68*a* and 68*b* so as to release the image forming unit 72 from the rotatable body 54. Subsequently, a fresh image forming unit with an empty cleaning casing 44 and a full developing casing 28 or an image forming unit with a developing device which stores toner of another color is mounted, as shown in FIG. 4. The new image forming unit is fixed in place by the latches 70*a* and 70*b* and, then, the rotatable body 54 is rotated as indicated by an arrow B until the image forming unit 72 reaches the position of FIGS. 1 to 3, i.e. an operative position. In the operative position, the developing device 24 and the cleaning device 40 of the unit 72 are ready to perform their predetermined functions as previously stated.

Likewise, when the life of the drum 16 expires, it may be replaced with another by raising the rotatable body 54 and image forming unit 72 to uncover the drum 16 and, then, vertically raising the drum 16 to remove it from the side plates 46*a* and 46*b*.

As described above, the developing device 24 and cleaning device 40 may be raised with the drum 16 left in the copier housing to replace the drum 16 and the image forming unit 72 independently of each other, as needed. Hence, in the event that the life of the drum 16 is longer than those of the developing device 24 and cleaning device 40 or when the drum 16 is damaged and has to be replaced alone, only that which should be discarded need be discarded, eliminating wastage. Further, in the case that a plurality of image forming units 72 each having a developing device 24 which stores toner of a particular color are prepared and selectively used, the production cost per unit is cut down since the drum 16 is not built into any of the units 72. In addition, since the drum 16 is left in the housing of the copier 10 when the rotatable body 54 is raised, it is not necessary for the image forming unit 72 to be equipped with shield members otherwise required for a drum. This further promotes a reduction of cost of the unit 72.

In the above construction, should the image forming unit 72 interfere with the drum 16 which is supported by the copier housing while the rotatable body 54 is moved to its open or closed position, it would not only disturb the smooth movement of the body 54 but would also scratch the drum 16. Furthermore, when the image forming unit 72 is in the operative position as shown in FIGS. 1 and 2, lower portions of the developing device 24 and cleaning device 40 are open so as not to interfere with the drum 16. Specifically, an opening 76 is defined between the devices 24 and 40 so that the drum 16 may be positioned without any interference. Hence, if the devices 24 and 40 are raised away from the copier housing with the opening 76 not closed when the rotatable body 54 is moved in the direction A, toner may fall through the opening 76. In the illustrative embodiment, guide means 78*a* and 78*b* are provided so that the developing device 24 may be rotated about the support pins 64*a* and 64*b* relative to the cleaning device 40 when the rotatable body 54 is moved, thereby preventing the image forming unit 72 from interfering with the drum 16. Another function of the guide means 78*a* and 78*b* is closing the opening 76 during the movement of the rotatable body 54 toward the open position and, thereby, preventing toner from falling through the opening 76. A specific construction of the guide means 78*a* and 78*b* will be described hereinafter. It is to be noted that the guide means 78*a* and 78*b* which are associated with the side plates 46*a* and 46*b*, respectively, are the same in construction and operation as each other. The following description therefore, will concentrate on the guide means 78*a* by way of example.

As shown in FIG. 3, the guide means 78*a* comprises a cam 80*a* which is constituted by a part of the copier housing, and a cam follower constituted by a control pin 82*a* which is studded on the developing device 24. The cam 80*a* is defined by a first cam surface 84*a* and a second cam surface 88*a* which are parallel to each other. While the first cam surface 84*a* is formed on the side plate 46*a* of the copier housing, the second cam surface 88*a* is formed on a movable member 86*a* which is usually fixed at the position shown in FIGS. 1 to 3. Movably supported by the side plate 46*a*, the member 86*a* is operated as will be described in detail later.

While the image forming unit 72 is in the operative position shown in FIGS. 1 to 3, the control pin, or cam follower, 82*a* rests on a bottom portion of the first cam surface 84*a*. When the rotatable body 54 is raised about the pins 52*a* and 52*b* in the direction A so as to rotate the image forming unit 72 away from the drum 16, the cam follower 82*a* is guided by the cam 80*a* as represented by consecutive positions I(82*a*) to VII(82*a*) in FIG. 5. Interlocked with the cam follower 82*a*, the developing casing 28 is also rotated clockwise about the pins 52*a* and 52*b* from a position I(28) to a position VII(28). Consequently, the developing casing 28 is moved toward the cleaning casing 44 while rotating about the support pins 64*a* and 64*b* with the support pins 64*a* and 64*b* supporting both the devices 24 and 40. Stated another way, the profile of the cam 80*a* is selected such that the end 90 of the developing casing 28 sequentially approaches the cleaning device 40 along the locus which is defined by the positions I(28) to VII(28) as the rotatable body 54 is rotated in direction A. In this instance, the end 90 of the developing casing 28 which is nearest to the drum 16 in the operative position of the developing device 24 is spaced by a predetermined small distance δ (e.g. 1 millimeter) from the drum 16 while the developing casing 28 is moved from the position I(28) to III(28), but the distance is sharply increased as the casing 28 reaches the position IV(28). This allows the developing device 24 to approach the cleaning casing 44 without interfering with the drum 16. Further, in the illustrative embodiment, the cleaning casing 44 is so located as not to interfere with the drum 16, allowing the whole unit 72 to rotate without making contact with the drum 16.

As stated above, when the rotatable body 54 is moved toward its open position, the end 90 of the developing device 24 is sequentially brought closer to the cleaning device 40 and, therefore, the opening 76 between the devices 24 and 40 is sequentially closed. As shown in FIG. 4, the end 90 of the developing casing 28 which is spaced apart from the copier housing is abutted against the cleaning blade 42 to substantially close the opening 76, whereby toner is prevented from falling through the opening 76. As shown in FIG. 4, although a clearance 92 remains between the facing ends of the devices 24 and 40, the leak of toner through the clearance 92 does not, or substantially does not, occur. If desired, however, a seal, not shown, which is constituted by sponge or an elastic sheet of foamed material may be fitted to the developing casing 28 or the cleaning casing 44 in a manner which per se is well known in the art, the seal sealing the clearance 92 to further positively eliminate the leak of toner.

As shown in FIG. 4, when the image forming unit 72 is removed from the copier housing, the developing device 24 and the cleaning device 40 may be closed by rotatably bringing the former closer to the latter. This contributes to a reduction of overall dimensions of the image forming unit 72 and, therefore, to a reduction of space required.

Conversely, when the rotatable body 54 is moved from the open or inoperative position shown in FIG. 4 toward the closed or operative position as indicated by the arrow B, the cam follower 82*a* is regulated by the cam 80*a* in the opposite manner to the aforementioned, resulting that the developing device 24 is sequentially moved away from the cleaning device 40 while rotating counterclockwise about the support pins 64*a* and 64*b*. The opening 76, therefore, is sequentially uncovered and becomes wide enough to accommodate the drum 16 when the image forming unit 72 reaches the operative position. In this manner, when the image forming unit 72 is brought from the inoperative position to the operative position, it is again prevented from interfering with the drum 16.

As shown in FIGS. 2 to 5, a toggle spring 94*a* which is implemented with a tension spring is anchored at one end to the developing casing 28 and at the other end to the cleaning casing 44. Likewise, a toggle spring 94*b* is associated with the other guide means 78*b*. While the image forming unit 72 is in the operative position as shown in FIGS. 1 to 3, the toggle spring 94*a* constantly biases the developing device 24 counterclockwise about the support pins 64*a* and 64*b*, i.e., such that the opening 76 between the developing device 24 and the cleaning device 40 tends to widen. However, since the cam follower 82*a* is engaged with the cam 80*a*, the developing device 24 is prevented from opening more than the position shown in FIGS. 1 to 3.

Figure 5:
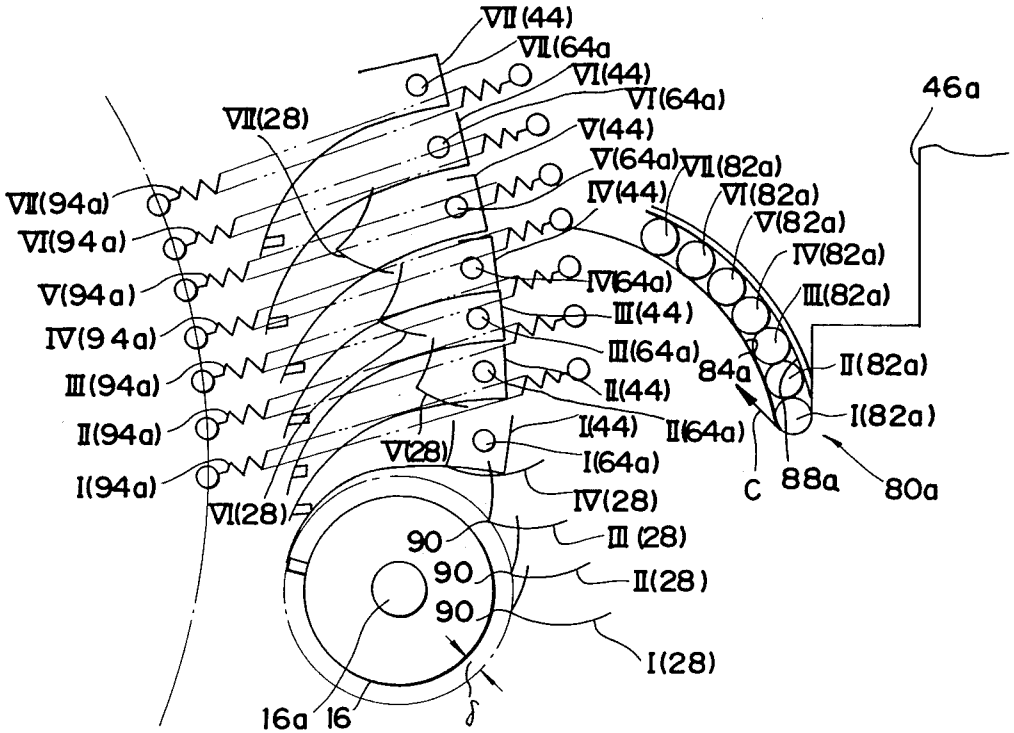
FIG. 5 is a view schematically showing the movements of various elements which occur when an image forming unit is raised.

When the rotatable body 54 is moved in the direction A with the control pin 82*a* sequentially shifted from the position I(82*a*) to the position VII(82*a*) as shown in FIG. 5, the toggle spring 94*a* crosses the axis of the support pin. Specifically, while the support pin 64*a* is sequentially shifted from a position I(64*a*) to a position IV(64*a*), the toggle spring 94 sequentially assumes positions I(94*a*) to IV(94*a*) above the support pin 64*a*, biasing the developing device 24 counterclockwise. However, as the support pin 64*a* is brought to positions VI(64*a*) and VII(64*a*), the toggle spring 94*a* becomes lower in level than the support pin 64*a* as represented by positions VI(94*a*) to VII(94*a*), resulting that the developing device 24 is biased clockwise about the support pin 64*a* and toward the cleaning device 40. Therefore, even after the cam follower 82*a* has been released from the cam 80*a*, the developing device 24 is held near the cleaning device 40 (position of FIG. 4) by the spring resiliency and, hence, the closed position of the devices 24 and 40 is surely maintained. When the image forming unit 72 is moved toward the operative position, a sequence opposite to the above-mentioned one occurs, i.e., the toggle spring 94*a* again urges the developing device 24 away from the cleaning device 40 when the opening degree between the devices 24 and 40 exceeds a predetermined one.

So long as the opening 76 between the cleaning device 40 and the developing device 24 is wider than predetermined one, the toggle spring 94*a* tends to move the devices 24 and 40 away from each other, as stated above. Under this condition, the cam follower 82*a* is constantly pressed against the second cam surface 88*a* by the force of the toggle spring 94*a* and, hence, the previously mentioned regulation over the developing device 24 is carried out by the second cam surface 88*a*. As the opening 76 is reduced beyond the predetermined one, the devices 24 and 40 are urged toward each other by the toggle spring 94*a* so that the cam follower 82*a* is instead regulated by the first cam surface 84*a*. After the cam follower 82*a* has been released from the cam 80*a*, the devices 24 and 40 are maintained in the closed position of FIG. 4 by the force of the toggle spring 94*a* alone. Should the toggle spring 94*a* be absent, the cam follower 82*a* might hit against the first cam surface 84*a* as indicated by an arrow C (FIG. 5) and thereby be locked in position when it must begin to move upward from the position I(82*a*) of FIG. 5. The toggle spring 94*a* serves to bias the developing device 24, and therefore the cam follower 82*a*, away from the first cam surface 84*a*, preventing the cam follower 82*a* from hitting against the first cam surface 84*a*. This allows the cam follower 82*a* to begin to move upward smoothly. While the biasing means for biasing the developing device 24 and cleaning device 40 toward and away from each other has been shown and described as comprising the toggle spring, or tension spring, 94*a*, it may alternatively be implemented with a torsion spring or the like.

Figure 6:
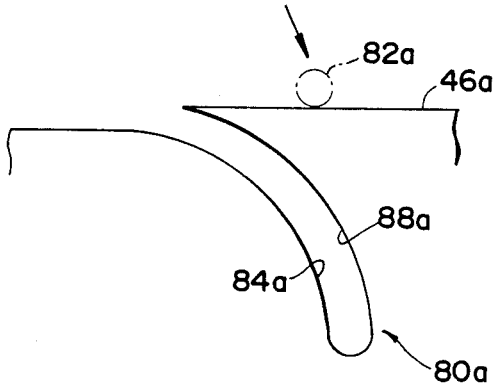
FIG. 6 is a view showing an alternative construction of the guide structure.

As shown in FIG. 6, the first and second cam surfaces 84*a* and 88*a*, respectively, may be defined by a single recess which is formed through the side plate 46*a*. Such a single recess scheme has a drawback, however. Specifically, assume that the developing device 24 is rotated about support pin 64A so as to be opened relative to the cleaning device 40, i.e., to the position of FIG. 1, for one reason or another while the rotatable body 54 is raised. Then, since the opened position is maintained by the toggle spring 94*a*, the developing device 24 cannot be returned to the operative position of FIG. 1 due to the abutment of the control pin 82*a* against the top of the side plate 46*a*, as indicated by a dash-and-dot line in FIG. 6.

Figure 7:
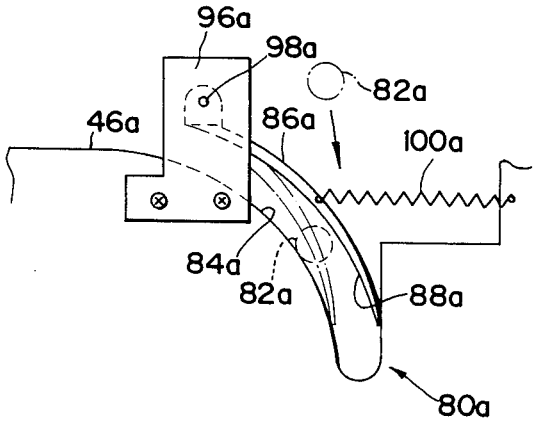
FIG. 7 is a view showing the operation of the guide structure of FIG. 2.

In light of the above, in the illustrative embodiment, the second cam surface 88*a* is defined by the movable member 86*a* the upper end of which is pivotally connected by a pin 98*a* to a bracket 96*a*, FIGS. 2 and 3, which is in turn fixed to the side plate 46*a*, as briefly described before and as shown in FIG. 7. The movable member 86a is constantly biased by a tension spring 100a to the right as viewed in FIG. 7, the lower end of the member 86a remaining in pressing contact with the side plate 46a. In this construction, when the image forming unit 72 is raised away from the copier housing and, then, lowered to the operative position with the developing device 24 opened relative to the cleaning device 40, the cam follower 82a is lowered toward the right-hand side of the movable member 86a, as indicated by the arrow in FIG. 7. Then, the cam follower 82a abuts against the movable member 86a to urge it about the pin 98a against the action of the spring 100a to a position which is indicated by a dash-and-dot line in the figure. Hence, the cam follower 82a is successfully admitted in the bottom portion of the first cam surface 84a over the movable member 86a. As soon as the cam follower 82a is received in the bottom portion of the first cam surface 84a, the movable member 86a regains its original position as indicated by a solid line due to the resiliency of the spring 100a. When the image forming unit 72 is again raised, therefore, the cam follower 82a can move between the opposite cam surfaces 84a and 88a as indicated by a dashed line in FIG. 7.

As previously stated, when the image forming unit 72 is raised from or lowered to the operative position, the end 90 of the developing casing 28 is moved while maintaining the gap δ (FIG. 5) between it and the drum 16. An exemplary method of designing the profile of the cams 80a and 80b which causes the casing end 90 to so behave will be described taking the cam 80a by way of example.

Figure 8:
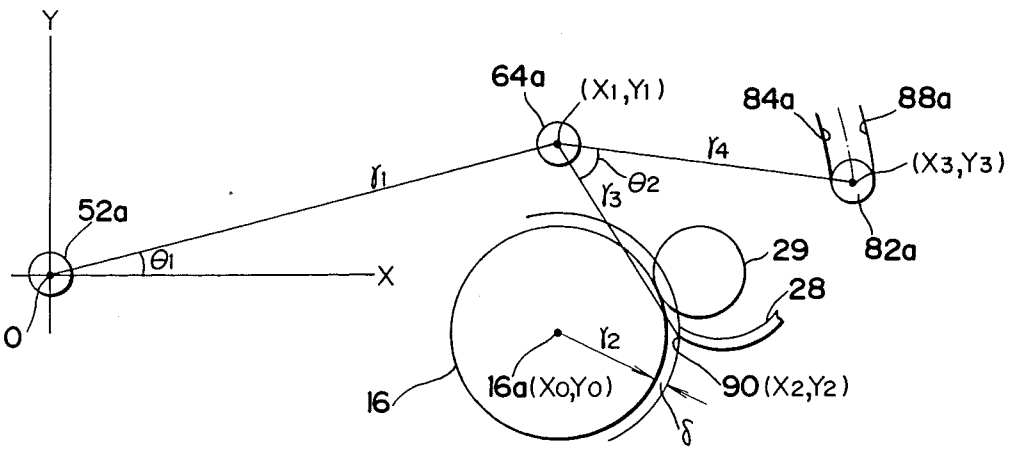
FIG. 8 is a schematic diagram for explaining how the profile of cam surfaces of the guide structure may be determined.

As shown in FIG. 8, assume coordinates of X and Y having an origin which is defined by the center O of the pin 52a. Let the coordinates of the center of the drum 16 be $(X_0, Y_0)$, those of the support pin 64a be $(X_1, Y_1)$, those of the end 90 of the developing casing 28 be $(X_2, Y_2)$, and those of the center of the control pin 82a be $(X_3, Y_3)$. Further, assume that the distance between the coordinates $(X_1, Y_1)$ and the origin O is $\gamma_1$, the radius of the drum 16 is $\gamma_2$, the distance between the coordinates $(X_1, Y_1)$ and $(X_2, Y_2)$ is $\gamma_3$, and the distance between the coordinates $(X_1, Y_1)$ and $(X_3, Y_3)$ is $\gamma_4$. Assuming that the angle between the line interconnecting the origin O and the coordinates $(X_1, Y_1)$ is $\theta_1$, the coordinates $(X_1, Y_1)$ are expressed as:

$$\left.\begin{aligned} X_1 &= \gamma_1 \cos\theta_1 \\ Y_1 &= \gamma_1 \sin\theta_1 \end{aligned}\right\} \qquad \text{Eq. (1)}$$

The coordinates $(X_2, Y_2)$ exist at the point of intersection of a circle having a radius $\gamma_3$ and a center $(X_1, Y_1)$ and a circle having a radius $(\gamma_2+\delta)$ and a center $(X_o, Y_o)$, these circles being represented by, respectively, the following equations (2) and (3):

$$(X_2-X_1)^2+(Y_2-Y_1)^2=\gamma_3^2 \qquad \text{Eq. (2)}$$

$$(X_2-X_0)^2+(Y_2-Y_0)^2=(\gamma_2+\delta)^2 \qquad \text{Eq. (3)}$$

Hence, the coordinates $(X_2, Y_2)$ are produced by using the Eqs. (2) and (3).

On the other hand, assuming that the line interconnecting the coordinates $(X_1, Y_1)$ and $(X_3, Y_3)$ and the line interconnecting the coordinates $(X_1, Y_1)$ and $(X_2, Y_2)$ make an angle $\theta_2$ therebetween, the center $(X_3, Y_3)$ of the control pin 82a is obtained by solving the following equations (4) and (5):

$$(X_3 - X_1)^2 + (Y_3 - Y_1)^2 = \gamma_4^2 \qquad \text{Eq. (4)}$$

$$(X_3 - X_2)^2 + (Y_3 - Y_2)^2 = (\gamma_3^2 + \gamma_4^2 - 2\gamma_3\gamma_4\cos\theta_2) \qquad \text{Eq. (5)}$$

In this manner, by sequentially determining the points $(X_3, Y_3)$ each being associated with a different $\theta_1$ as produced by rotating the rotatable body 54, it is possible to define the center locus of the control pin 82a during the movement of the coordinates $(X_2, Y_2)$ spaced by δ from the rum 16, i.e. the profile of the first cam surface 84a or that of the second cam surface 88a.

SECOND EMBODIMENT

In a second embodiment of the present invention which will be described, the same or similar structural elements as those of the first embodiment are designated by like reference numerals.

Figure 9:
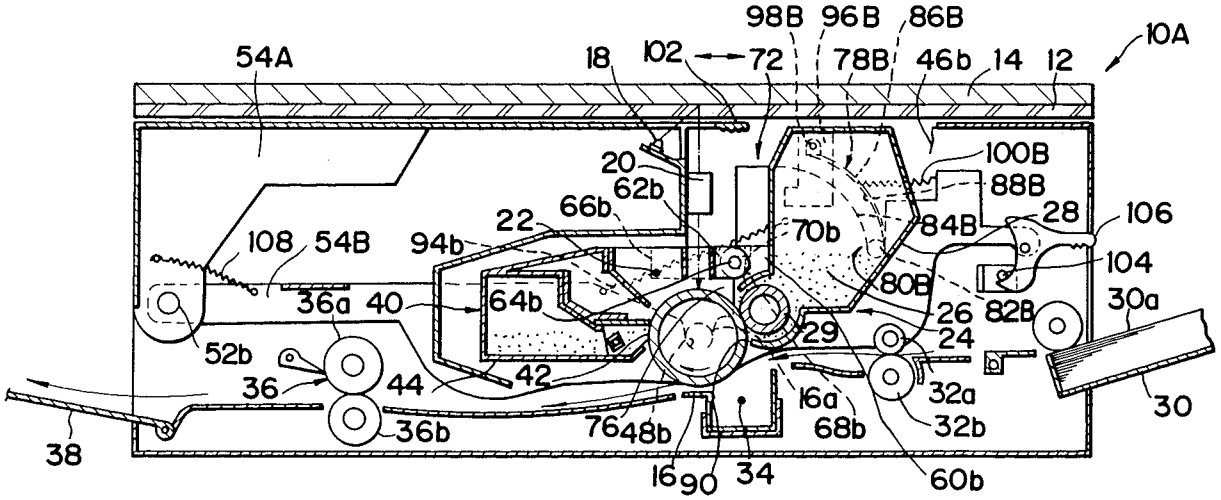
FIG. 9 is a vertical section of an electrophotographic copier which is taken along its center and is representative of a second embodiment of the present invention.

Referring to FIG. 9, an electrophotographic copier 10A includes the glass platen 12 which is located in the upper portion of the copier housing and movable horizontally in a reciprocal motion. An original document, not shown, is laid on the glass platen 12 and pressed from above by the presser plate 14. The drum 16 is rotatably disposed in the copier housing to serve as an image carrier. In operation, the glass platen 12 and the presser plate 14 are moved in the horizontal direction as indicated by an arrow in the figure while, at the same time, the light source 18 is turned on to illuminate the document on the glass platen 12. Light reflected by the document is propagated through the condensing light-transmitting element 20 to become incident to the surface of the drum 16, which is rotating counterclockwise as viewed in the figure. Since the surface of the drum 16 has been electrostatically charged beforehand with a predetermined polarity by the charger 22, a latent image associated with the document is formed on the drum surface which is exposed imagewise as stated above. When the latent image is moved past the developing device 24, it is developed by toner 26 to become a toner image. The developing casing 28 stores the toner 26, and the developing roller 29 transports the toner 26 toward the drum surface by carrying it on its periphery. The toner 26 is electrostatically transferred from the developing roller 29 to the drum 16 to develop the latent image. Again, use may be made of a two-component developer which is a mixture of toner and carrier.

The paper sheets 30a are fed from the paper cassette 30 toward the register rollers 32a and 32b, the paper cassette 30 being detachably mounted in the copier housing. At a predetermined appropriate timing, a paper sheet 30a is driven by the register rollers 32a and 32b through a space between the surface of the drum 16 and the transfer charger 34 so that the toner image is transferred from the drum 16 to the paper sheet 30a. Then, the paper sheet 30a is moved through the fixing device 36 which is made up of the fixing rollers 36a and 36b, whereby the toner image on the paper sheet 30a is fixed. Subsequently, the paper sheet 30a is fed out of the copier housing to the tray 38. The toner remaining on the drum 16 after the transfer of the toner image is removed by the cleaning member of a cleaning device 40 which is implemented with the cleaning blade 42 which makes contact with the drum 16. The toner collected in this manner is retained in the cleaning casing 44.

Figure 10:
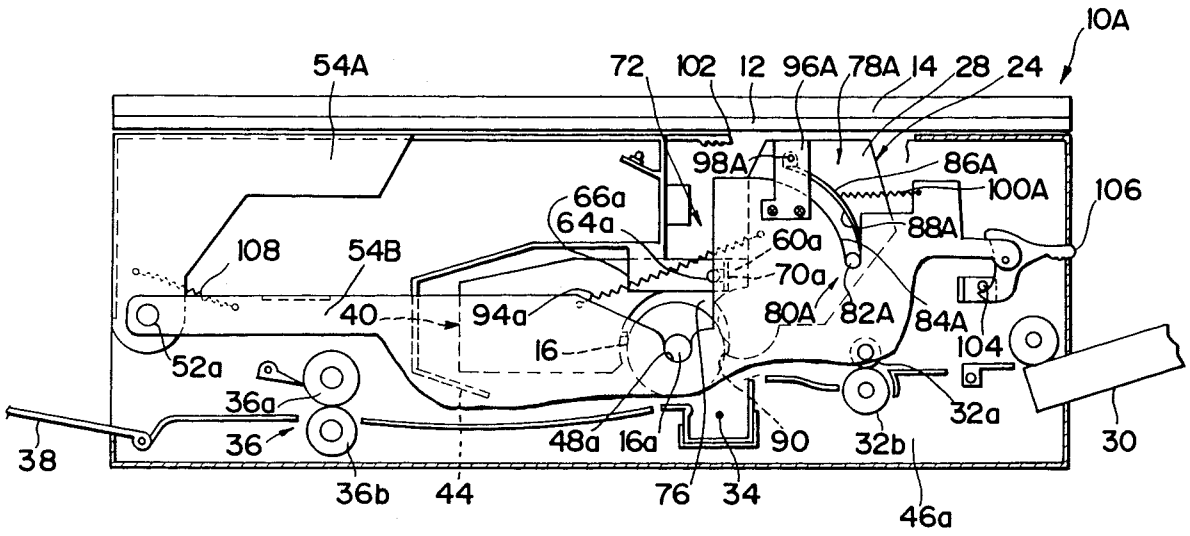
FIG. 10 is a section of the copier of FIG. 9 taken at a position in front of a second rotatable body.

A first rotatable body 54*a* is rotatably supported via the pins 52*a* and 52*b* by the spaced front and rear side plates 46*a* and 46*b*, respectively. As shown in FIGS. 9 and 10, the rotatable body 54A is usually held in a closed or operative position below the glass platen 12 and retained there by a stop or a locking device, not shown. Likewise, a second rotatable body 54B is supported by the side plates 46*a* and 46*b* through the pins 52*a* and 52*b*, respectively. This rotatable body 54B, too, is usually received in the copier housing, as shown in FIGS. 9 and 10. The first and second rotatable bodies 54A and 54B, respectively, are rotatable independently of each other. The second rotatable body 54B is provided with the recesses 48*a* and 48*b* in which support shafts 16*a* and 16*b* of the drum 16, respectively, are rotatably and detachably received.

Figure 11:
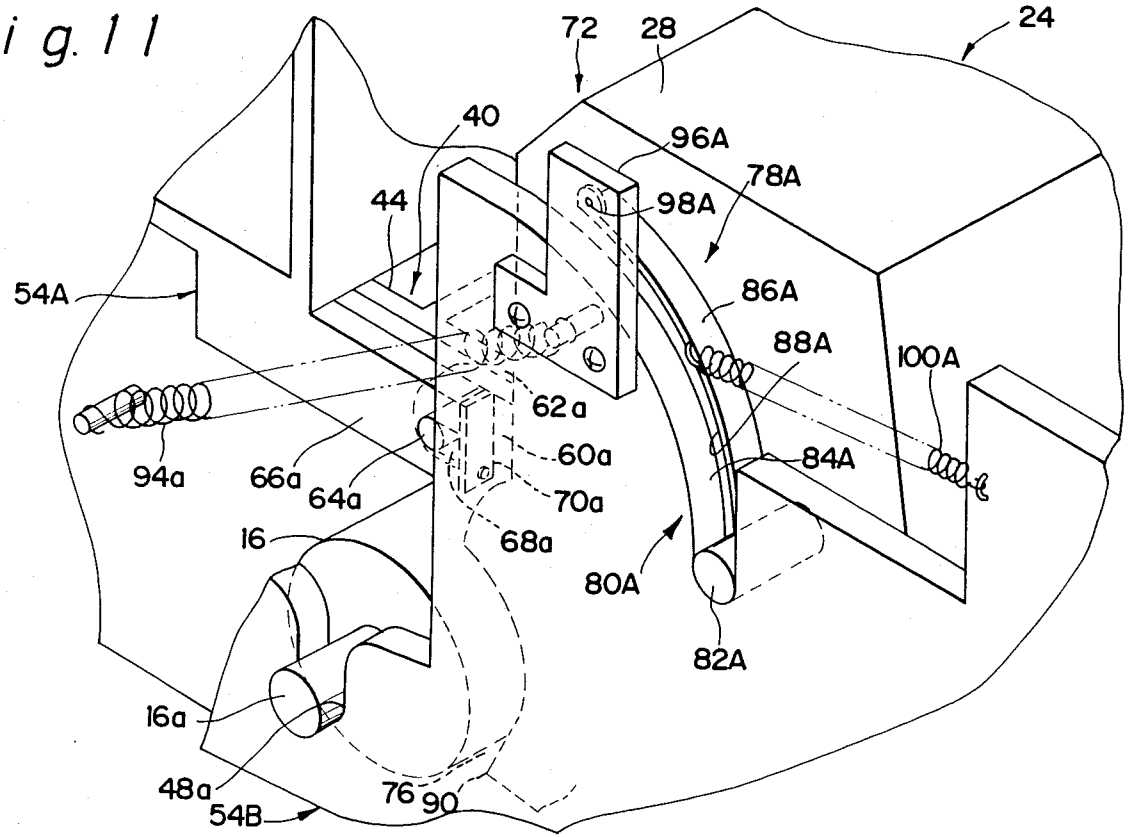
FIG. 11 is a perspective view of guide structure is shown in FIG. 10.

The pair of ears 60*a* and 60*b* and the pair of ears 62*a* and 62*b*, FIG. 11, protrude from the developing casing 28 and the cleaning casing 44, respectively. The support pins 64*a* and 64*b* are rotatably engaged with the ears 60*a* and 62*a* and the ears 60*b* and 62*b*, respectively. In this construction, the developing device 24 and the cleaning device 40 are rotatable relative to each other via the support pins 64*a* and 64*b*. The support pins 64*a* and 64*b* are rotatably supported by recesses 68*a* and 68*b* which are formed in the ears 66*a* and 66*b* of the first rotatable body 54A. The latches 70*a* and 70*b*, which are either rotatable or removable, prevent the support pins 64*a* and 64*b* from slipping out of their associated recesses 68*a* and 68*b*.

The developing device 24 and the cleaning device 40 constitute the image forming unit 72 which is retained by the first rotatable body 54A through the support pins 64*a* and 64*b*. In addition, the cleaning device 40 is rotatably retained by the rotatable body 54A through other members, not shown, to be thereby safeguarded against shaking. In this embodiment, too, the light source 18 and light-transmitting element 20 are fixed to the rotatable body 54A while the charger 22 is provided in the cleaning casing 44. Hence, the charger 22, too, constitutes a part of the image forming unit 72. One 32*a* of the register rollers is rotatably supported by the second rotatable body 54B. As shown in the figures, other various image forming elements are arranged in the copier housing.

In the condition shown in FIGS. 9 to 11, the developing device 24 and the cleaning device 40 of the image forming unit 72 are operatively joined with the drum 16 so as to be capable of performing the previously stated copying operation. This position of the devices 24 and 40 will hereinafter be referred to as an operative position.

Figure 12:
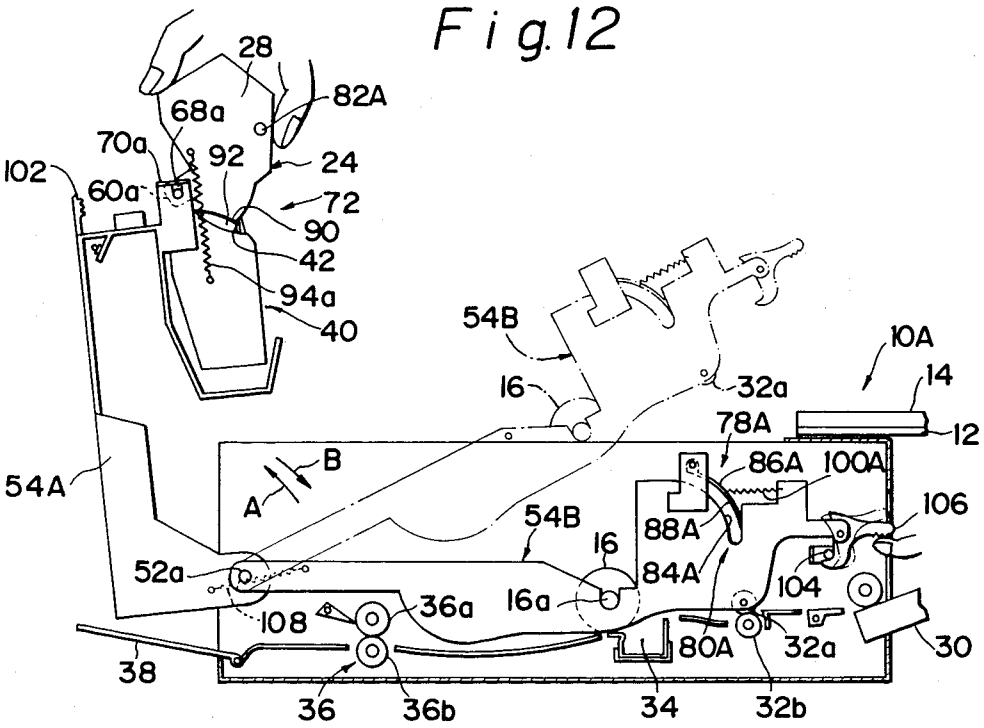
FIG. 12 is a section similar to FIG. 10, showing the copier with a first rotatable body raised to its open position.

To replace the developing device 24 or the cleaning device 40 whose life has expired or to replace the device 24 with another which stores toner of a different color, the glass platen 12 is retracted to the right together with the presser plate 14, as shown in FIG. 12. After a locking device such as the lock lever 56 and lock pin 58 of the first embodiment, if provided, has been released, the first rotatable body 54A is raised by gripping a thumb piece 102 which is provided in an upper portion of the rotatable body 54A. At this instant, the second rotatable body 54B remains unmoved because a lock lever 106 rotatably connected to the body 54B is engaged with a lock pin 104 which is studded on the side plate 46*a*. In this condition, the first rotatable body 54A is raised by being rotated counterclockwise (arrow A) about the pins 52*a* and 52*b* and away from the drum 16. Upon reaching the open or inoperative position shown in FIG. 12, the body 54A is fixed in the inoperative position by a stop, not shown. In the open position, the center of gravity of the rotatable body 54A and image forming unit 72 is located at the left of the pins 52*a* and 52*b* as viewed in FIG. 12, and so the body 54A is stably maintained in the inoperative position of FIG. 12 even if the operator's hand is removed from the body 54.

The drum 16 remains in the copier housing supported by the second rotatably body 54B. Hence, the image forming unit 72 is located in the inoperative position above the copier housing while being greatly spaced apart from the drum 16. In this condition, by rotating or removing the latches 70*a* and 70*b*, the support pins 64*a* and 64*b* may be removed from their associated recesses 68*a* and 68*b* of the first rotatable body 54A so as to release the image forming unit 72 from the rotatable body 54A. Subsequently, a fresh image forming unit with an empty cleaning casing 44 and a full developing casing 28 or an image forming unit with a developing device which stores toner of another color is mounted, as shown in FIG. 12. The new image forming unit is fixed in place by the latches 70*a* and 70*b* and, then, the rotatable body 54A is rotated as indicated by an arrow B until the image forming unit 72 reaches the operative position of FIGS. 9 to 11. In the position of FIGS. 9 to 11, the image forming unit 72 is operatively joined with the drum 16, as previously stated.

Likewise, when the life of the drum 16 expires, it may be replaced with another by raising the first rotatable body 54A and image forming unit 72, with the second rotatable body 54B left in the copier housing so as to uncover the drum 16, and then vertically raising the drum 16 to remove it from the second rotatably body 54B.

As described above, the developing device 24 and cleaning device 40 may be raised with the drum 16 left in the copier housing to replace the drum 16 and the image forming unit 72 independently of each other, as needed. Hence, in the event that the life of the drum 16 is longer than those of the developing device 24 and cleaning device 40, or when the drum 16 is damaged and has to be replaced alone, all that is required is discarding only that which should be discarded, eliminating waste. Further, in the case that a plurality of image forming units 72 each having a developing device 24 which stores toner of a particular color are prepared to be selectively used, the production cost per unit is cut down because the drum 16 is not built in any of the units 72. In addition, since the drum 16 is left in the housing of the copier 10 when the first rotatable body 54A is raised, it is not necessary for the image forming unit 72 to be equipped with shield members otherwise required for a drum. This further promotes a reduction of cost for the unit 72.

During copying operation, the paper sheet 30*a* is transported through the path which is defined below the drum 16, as previously described. In the event of trouble being caused by the paper sheet 30*a* being transported, the drum 16 located in the position shown in FIGS. 9 and 10 would obstruct any manipulation for dealing with the trouble. This also holds true for the inspection of those elements which are disposed below the drum 16. In such a case, the lock lever 106 is rotated by finger to release it from the lock pin 104. Then, the thumb piece 102 or the lever 106 is raised to together move both the first and second rotatable bodies 54A and 54B in the direction A to the inoperative position of FIG. 13, with the image forming unit 72 and the drum 16 remaining unseparated. This causes the entire transport path for the paper sheet 30*a* to be uncovered and, thereby, allows the paper sheet 30*a* jamming the path to be removed with ease, while facilitating the operator's access to any of the various elements which are exposed. Naturally, as indicated by a dash-and-dot line in FIG. 12, the second rotatable body 54B may be separated from the first rotatable body 54A and raised independently of the latter. Preferably, the second rotatable body 54B is provided with a latch or like separation preventing member, not shown, so that the drum 16 may be prevented from slipping off the recesses 48*a* and 48*b* of the rotatable body 54B when the body 54B is raised.

Figure 13:
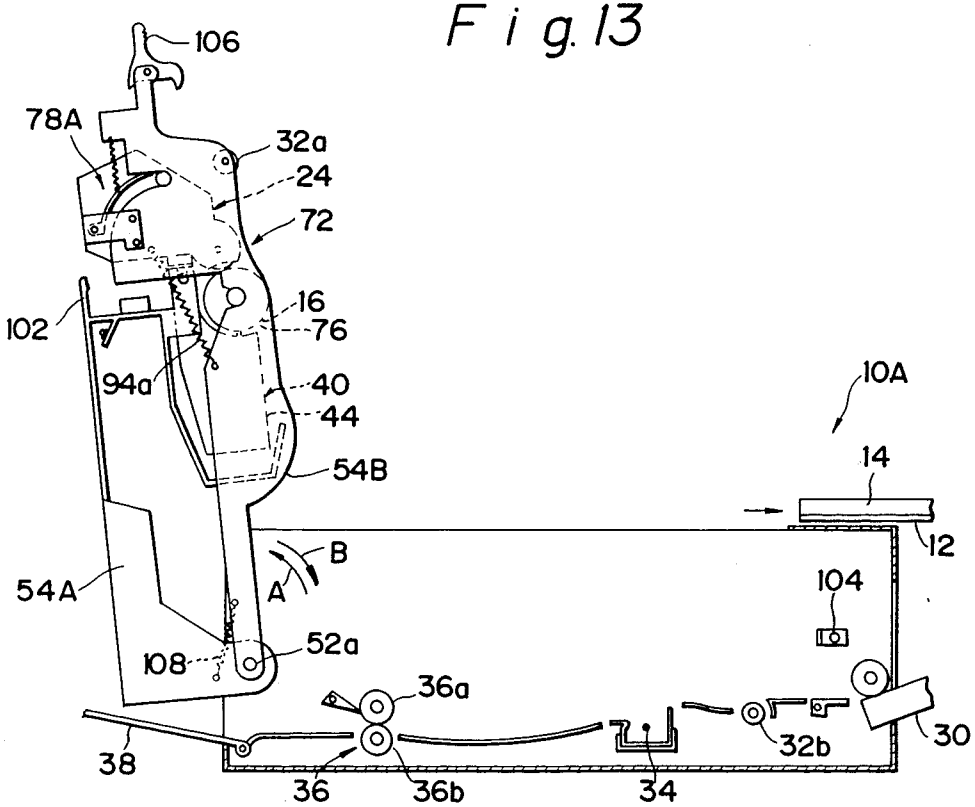
FIG. 13 is a view similar to FIG. 12, showing the copier with both the first and second rotatable bodies raised.

A toggle spring 108 which is implemented with a tension spring is anchored at one end to the first rotatable body 54A and at the other end to the second rotatable body 54B. The toggle spring 108 operates such that when the angle of opening defined between the rotatable bodies 54A and 54B is increased beyond a predetermined one, the bodies 54A and 54B are urged away from each other and, when the angle of opening is decreased beyond the predetermined one, they are urged toward each other. This eliminates an occurrence that when the bodies 54A and 54B are raised with the drum 16 and the image forming unit 72 combined together as shown in FIG. 13, only the body 54A is moved upward. Further, as indicated by a solid line in FIG. 12, when the second rotatable body 54B is greatly spaced apart from the first rotatable body 54A, the toggle spring 108 maintains the body 54A upright and the body 54B received in the copier housing, facilitating the operator's access for any desired operation.

In the event that the image forming unit 72 and the drum 16 are moved toward and away from each other by the relative angular movement of the two rotatable bodies 54A and 54B, should the image forming unit 72 interfere with the drum 16, it would not only disturb the smooth movement of the bodies 54A and 54B but would also scratch the drum 16. Furthermore, when the image forming unit 72 and the drum 16 are held in the operative position as shown in FIGS. 9 and 10 or in the inoperative position as indicated by solid lines in FIG. 13, lower portions of the developing device 24 and cleaning device 40 are open so as not to interfere with the drum 16. Specifically, the opening 76 is defined between the devices 24 and 40 so that the drum 16 may be positioned without any interference. Hence, if the rotatable bodies 54A and 54B are moved away from each other to separate the image forming unit 72 and the drum 16 with the opening 76 not closed, as shown in FIG. 9, toner may fall through the opening 76. In the illustrative embodiment, guide means 78A and 78B are provided so that the developing device 24 may be rotated about the support pins 64*a* and 64*b* relative to the cleaning device 40 during relative opening and closing movement of the rotatable bodies 54A and 54B, thereby preventing the image forming unit 72 from interfering with the drum 16. The guide means 78A and 78B, therefore, serve to close the opening 76 when the image forming unit 72 and the drum 16 are moved away from each other, whereby toner is prevented from falling through the opening 76. A specific construction of the guide means 78A and 78B will be described hereinafter. It is to be noted that the guide means 78A and 78B which are disposed in, respectively, the front and rear portions of the copier 10A are the same in construction and operation as each other. The following description, therefore, will concentrate on the guide means 78A by way of example.

As shown in FIG. 11, the guide means 78A comprises a cam 80A which is constituted by a part of the second rotatable body 54B, and a cam follower constituted by a control pin 82A which is studded on the developing device 24. The cam 80A is defined by a first cam surface 84A and a second cam surface 88A which are parallel to each other. While the first cam surface 84A is formed on the second rotatable body 54B, the second cam surface 88A is formed on a movable member 86A which is usually fixed at the operative position shown in FIGS. 9 to 11. Movably supported by the second rotatable body 54B, the member 86A is operated as will be described in detail later.

While the image forming unit 72 and the drum 16 are in the operative position, the control pin 82A rests on the bottom of the first cam surface 84A, as shown in FIGS. 9 to 11. When the first rotatable body 54A is raised about the pins 52*a* and 52*b* in the direction A so as to rotate the image forming unit 72 away from the drum 16 with the drum 16 and second rotatable body 54B left in the copier body, the cam follower 82A is guided by the cam 80A as represented by consecutive positions I(82A) to VII(82A) in FIG. 14. Interlocked with the cam follower 82A, the developing casing 28 is also rotated clockwise about the pins 52*a* and 52*b* from a position I(28) to a position VII(28). Consequently, the developing casing 28 is moved toward the cleaning casing 44 while rotating about the support pins 64*a* and 64*b* with the support pins 64*a* and 64*b* supporting both the devices 24 and 40. Stated another way, the profile of the cam 80A is selected such that the end 90 of the developing casing 28 sequentially approaches the cleaning device 40 along the locus which is defined by the positions I(28) to VII(28) as the rotatable body 54A is rotated in the direction A. In this instance, the end 90 of the developing casing 28 which is nearest to the drum 16 in the operative position of the image forming unit 72 and drum 16 is spaced by a predetermined small distance $\delta$ (e.g. 1 millimeter) from the drum 16 while the casing 28 is moved from the position I(28) to the position III(28), but the distance is sharply increased as the casing 28 reaches the position IV(28). This allows the developing device 24 to approach the cleaning casing 44 without interfering with the drum 16. Further, in the illustrative embodiment, the cleaning casing 44 is so located as not to interfere with the drum 16, allowing the whole unit 72 to rotate without making contact with the drum 16.

As stated above, when the first rotatable body 54A is moved toward its open position, the end 90 of the developing device 24 is sequentially brought closer to the cleaning device 40 and, therefore, the opening 76 between the devices 24 and 40 is sequentially reduced. As shown in FIG. 12, the end 90 of the developing casing 28 which is spaced apart from the drum 16 is abutted against the cleaning blade 42 to substantially close the opening 76, whereby toner is prevented from falling through the opening 76. Again, although the clearance 92 is defined between the facing ends of the devices 24 and 40 as shown in FIG. 12, the leak of toner through the clearance 92 does not, or substantially does not, occur. If desired, however, a seal, not shown, which is constituted by sponge or an elastic sheet of foamed material may be fitted to the developing casing 28 or the cleaning casing 44 in a manner which per se is well known in the art, the seal sealing the clearance 92 to further positively eliminate the leak of toner.

When the image forming unit 72 is spaced apart from the drum 16 as represented by a solid line in FIG. 12, the developing device 24 and the cleaning device 40 may be closed by bringing the former closer to the latter. This contributes to a reduction of overall dimensions of the image forming unit 72 and, therefore, to a reduction of the space required.

Conversely, when the first rotatable body 54A is moved from the open position indicated by a solid line in FIG. 12 in the direction B to join the image forming unit with the drum 12 in the operative condition, the cam follower 82A is regulated by the cam 80A in the opposite manner to that aforementioned, resulting in the develoing 24 being sequentially moved away from the cleaning device 40 while rotating counterclockwise about the support pins **64*a* and 64*b*. The opening 76, therefore, is sequentially uncovered and becomes wide enough to accommodate the drum 16 when the image forming unit 72 reaches the operative position where it is fully joined with the drum 16. In this manner, when the image forming unit 72 is brought from the open position to the closed position, it is prevented from interfering with the drum 16**.

As shown in FIGS. 10 to 14, the toggle spring, or tension spring, **94*a* is anchored at one end to the developing casing 28 and at the other end to the cleaning casing 44. A toggle spring 94*b* is associated with the other guide means 78B. While the image forming unit 72 is in the operative position where it is joined with the drum 16, the toggle spring 94*a* constantly biases the developing device 24 counterclockwise about the support pins 64*a* and 64*b*, i.e., such that the opening 76 between the developing device 24 and the cleaning device 40 tends to widen. However, since the cam follower 82A is engaged with the cam 80A, the developing device 24 is prevented from opening more than the position shown in FIGS. 9 to 11**.

Figure 14:
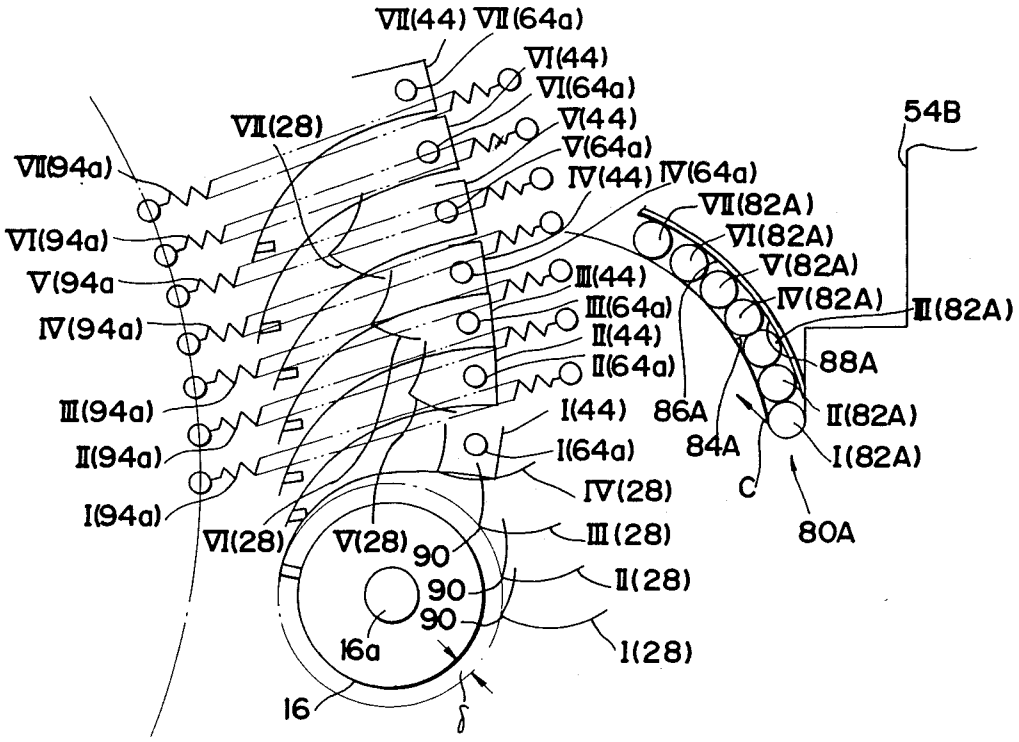
FIG. 14 is a view showing how an image forming unit and a photoconductive element are moved toward and away from each other.

When the first rotatable body 54A is moved in the direction A with the second rotatable body 54B held in the operative position of FIGS. 9 to 11 and with the control pin 82A sequentially shifted from the position I(**82*a*) to the position VII(82*a*) as shown in FIG. 14, the toggle spring 94*a* crosses the axis of the support pin 64*a*. Specifically, while the support pin 64*a* is sequentially shifted from a position I(64*a*) to a position IV(64*a*), the toggle spring 94 sequentially assumes positions I(94*a*) to IV(94*a*) above the support pin 64*a*, biasing the developing device 24 counterclockwise. However, as the support pin 64*a* is brought to positions VI(64*a*) and VII(64*a*), the toggle spring 94*a* becomes lower in level than the support pin 64*a* as represented by positions VI(94*a*) to VII(94*a*), resulting in the developing device 24 being biased clockwise about the support pin 64*a* and toward the cleaning device 40. Therefore, even after the cam follower 82A has been released from the cam 80A, the developing device 24 is held near the cleaning device 40 (position of FIG. 12) by the resiliency of the toggle spring 94*a* and, hence, the closed position of the devices 24 and 40 is surely maintained. When the image forming unit 72 is moved toward the drum 16, a sequence opposite to the above-mentioned one occurs, i.e., the toggle spring 94*a* again biases the developing device 24 away from the cleaning device 40 when the open position of the devices 24 and 40** exceeds a predetermined one.

So long as the opening 76 between the cleaning device 40 and the developing device 24 is wider than a predetermined one, the toggle spring **94*a* tends to move the devices 24 and 40 away from each other, as stated above. Under this condition, the cam follower 82A is constantly pressed against the second cam surface 88A by the force of the toggle spring 94*a* and, hence, the previously mentioned regulation over the developing device 24 is executed by the second cam surface 88A. As the opening 76 is reduced beyond the predetermined one, the devices 24 and 40 are urged toward each other by the toggle spring 94*a* so that the cam follower 82A is regulated by the first cam surface 84A. After the cam follower 82A has been released from the cam 80A, the devices 24 and 40 are maintained in the closed position of FIG. 12 by the force of the toggle spring 94*a* alone. Should the toggle spring 94*a* be absent, the cam follower 82A might hit against the first cam surface 84A as indicated by an arrow C (FIG. 14) and thereby be locked in position when it must begin to move upward from the position I(82*a*) of FIG. 14. The toggle spring 94*a* serves to bias the developing device 24 and, therefore, the cam follower 82A away from the first cam surface 84A, preventing the cam follower 82A from hitting against the first cam surface 84A. This allows the cam follower 82A to begin to move upward smoothly. While the biasing means for biasing the image forming unit to move the developing device 24 and cleaning device 40 toward and away from each other has been shown and described as comprising the toggle spring, or tension spring, 94*a*, it may alternatively be implemented with a torsion spring or the like. Likewise, the tension spring 108** adapted to bias the rotatable bodies may be replaced with a coil spring or the like.

Figure 15:
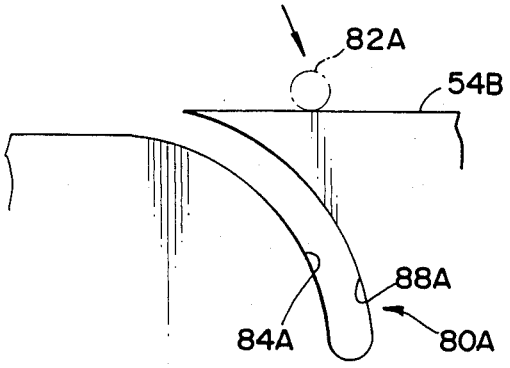
FIG. 15 is a view showing another specific construction of the guide structure.

As shown in FIG. 15, the first and second cam surfaces 84A and 88A, respectively, may be defined by a single recess which is formed through the second rotatable body 54B. Such a single recess scheme has a drawback, however. Specifically, assume that the developing device 24 is rotated about support pin 64A so as to be opened relative to the cleaning device 40, i.e., to the position of FIG. 9, for one reason or another while the first rotatable body 54A only is raised, as shown in FIG. 12. Then, since the opened position is maintained by the toggle spring **94*a*, the developing device 24 cannot be returned to the closed position of FIG. 1 due to the abutment of the control pin 82*a* against the top of the second rotatable body 54B, as indicated by a dash-and-dot line in FIG. 15**.

Figure 16:
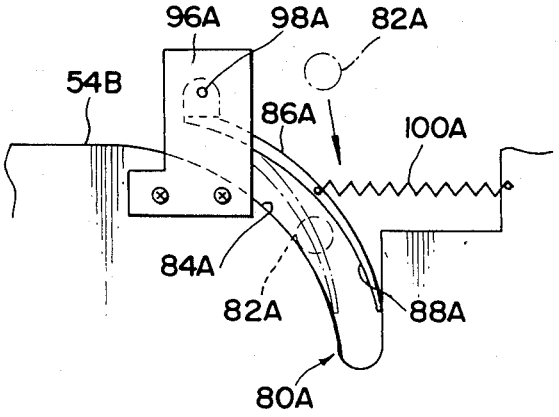
FIG. 16 is a view demonstrating the operation of the guide structure as shown in FIG. 10.

In light of the above, in the illustrative embodiment, the second cam surface 88A is defined by the movable member 86A the upper end of which is rotatably connected by a pin 98A to a bracket 96A, FIGS. 10 and 11, which is in turn fixed to the second rotatable body 54B, as briefly described before and as shown in FIG. 16. The movable member 86A is constantly biased by a tension spring 100A to the right as viewed in FIG. 16, the lower end of the member 86A remaining in pressing contact with the second rotatable body 54B. In this construction, when the image forming unit 72 is raised away from the copier housing with the drum 16 left in the copier housing and then lowered to the closed position with the developing device 24 opened relative to the cleaning device 40, the cam follower 82A is lowered forwards the right-hand side of the movable member 86A, as indicated by the arrow in FIG. 16. Then, the cam follower 82A abuts against the movable member 86A to urge it about the pin 98A against the action of the spring 100A to a position which is indicated by a dash-and-dot line in the figure. Hence, the cam follower 82A is successfully admitted to the bottom portion of the first cam surface 84A over the movable member 86A. As soon as the cam follower 82A is received in the bottom portion of the first cam surface 84A, the movable member 86A regains its original position as indicated by a solid line due to the action of the spring 100A. When the image forming unit 72 is raised, therefore, the cam follower 82A can move between the opposite cam surfaces 84A and 88A as indicated by a dashed line in FIG. 16.

When the image forming unit 72 is moved toward and away from the drum 16 which is held in the copier housing, the end 90 of the developing casing 28 is moved while maintaining the distance δ between it and the drum 16, as previously stated with reference to FIG. 14. The profile of the cam 80A which generates such a movement of the developing casing 28 may be determined by the same method as described in relation to the first embodiment.

The construction and operation of the guide means 78A, toggle spring 94*a* and others have been shown and described on the assumption that the first rotatable body 54A and image forming unit 72 are moved toward an away from the drum 16 with the second rotatable body 54B and drum 16 left in the copier housing. This is only illustrative, however. Specifically, they will be operated in exactly the same manner when the drum 16 and image forming unit 72 are moved toward and away from each other with the second rotatable body 54B and drum 16 also raised away from the copier housing. Further, while the first and second rotatable bodies 54A and 54B have been shown as rotatably supported by the copier housing via the common pins 52*a* and 52*b*, they may naturally be connected to the copier housing by independent members.

In any of the first and second embodiments, an arrangement is made such that the developing device is rotatable relative to the cleaning device about those positions where the two devices are rotatably supported, and the control pin, or cam follower, is provided in the developing device. Alternatively, the cleaning device may be constructed to be rotatable relative to the developing device in which case the control pin will be disposed in the cleaning device. Another alternative arrangement may be such that both the cleaning device and the developing device are rotatable about their common pivots and each is provided with a different control pin. The gist is that the guide means and/or the biasing means (corresponding to the toggle springs of the embodiments) are so constructed as to cause the developing device and the cleaning device to rotate relative to each other in such a manner as to open and close the opening defined therebetween.

In the first and second embodiments, as shown in FIGS. 4, 12 and 13, the rotatable bodies are angularly movable in the direction A to uncover the right-hand side of the copier housing. If desired, an arrangement may be made such that the front side of the rotatable body as viewed in the figures is movable upward and toward the rear side so as to uncover the front part of the copier housing.

In summary, it will be seen that in accordance with the present invention a developing device and a cleaning device are combined together to constitute an image forming unit which is replaceable independently of an image carrier, eliminating waste. The image forming unit is prevented from interfering with the image carrier while in movement. Any transferring material which has jammed a transport path can be removed with ease by raising a second rotatable member.

Various modifications will become possible for those skilled in the art after receiving the teachings of the present disclosure without departing from the scope thereof.

What is claimed is:

1. In an image forming apparatus having at least a housing, an image carrier in said housing for carrying an electrostatic latent image thereon, a developing device for developing said latent image to produce a visible image, and a cleaning device for forming a developer, a combination comprising:

a unit rotatable body rotatably supported relative to said housing for movement between an operative position and an inoperative position, wherein when said unit rotatable body is in said operative position, said developing and cleaning devices are positioned adjacent said image carrier with an opening defined between said developing and cleaning devices for accommodating said image carrier, means for pivotally supporting said developing and cleaning devices on said unit rotatable body, wherein said developing and cleaning devices together comprise an image forming unit; and positioning means for positively rotating said developing and cleaning devices relative to one another when said unit rotatable body is rotated between said operative and inoperative positions, wherein said positioning means comprises means for positioning said image forming unit relative to said image carrier when said unit rotatable body is rotated between said operative and inoperative positions and guide means for guiding at least one of said developing and cleaning devices to rotate about said means for pivotally supporting such that said image forming unit does not interfere with said image carrier, wherein said guide means comprises means for guiding said developing and cleaning devices such that when said unit rotatable body is moved from said operative position to said inoperative position, said developing and cleaning devices rotate about said pivots means for pivotally supporting so as to close said opening and, when said unit rotatable body is moved from said inoperative position to said operative position, said developing and cleaning devices rotate about said means for pivotally supporting so as to open said opening.

2. An image forming apparatus as claimed in claim 1, further comprising unit biasing means for biasing said developing and cleaning devices such that said opening is enlarged when larger than a predetermined degree and reduced when smaller than said predetermined degree, when said unit rotatable body is moved between said operative and inoperative positions.

3. An image forming apparatus as claimed in claim 2, wherein said unit biasing means comprises a toggle spring.

4. In an image forming apparatus having at least a housing, an image carrier in said housing for carrying an electrostatic latent image thereon, a developing device for developing said latent image to produce a visible image, and a cleaning device for removing a developer, a combination comprising:

a unit rotatable body rotatably supported relative to said housing for movement between an operative position and an inoperative position;

means for pivotally supporting said developing and cleaning devices on said unit rotatable body, wherein said developing and cleaning devices together comprise an image forming unit; and positioning means for positively rotating said developing and cleaning devices relative to one another when said unit rotatable body is rotated between said operative and inoperative positions, wherein said positioning means comprises means for positioning said image forming unit relative to said image carrier when said unit rotatable body is rotated between said operative and inoperative positions and guide means for guiding at least one of said developing and cleaning devices to rotate about said means for pivotally supporting such that said image forming unit does not interfere with said image carrier, wherein said guide means comprise cam means provided in said housing of said image forming apparatus, and cam follower means provided in at least one of said developing and cleaning devices, and wherein said cam means comprise a first cam surface defined by at least one of opposite side plates which form a part of said housing, a second cam surface defined by at least one movable member which is parallel to said first cam surface, a support member rotatably supporting one end of said movable member, movable member biasing means for biasing said movable member such that said second cam surface normally remains parallel to said first cam surface, and at least one pin provided in at least one of said developing and cleaning devices and positioned so as to be guided by said first and second cam surfaces.

5. In an image forming apparatus having at least a housing, an image carrier in said housing for carrying an electrostatic latent image thereon, a developing device for developing said latent image to produce a visible image, and a cleaning device for removing a developer, a combination comprising:

a unit rotatable body rotatably supported relative to said housing for movement between an operative position and an inoperative position;

means for pivotally supporting said developing and cleaning devices on said unit rotatable body, wherein said developing and cleaning devices together comprise an image forming unit;

positioning means for positively rotating said developing and cleaning devices relative to one another when said unit rotatable body is rotated between said operative and inoperative positions;

a carrier rotatable body rotatably supported relative to said housing of said image forming apparatus between an operative position and an inoperative position, and detachably supporting said image carrier, wherein said unit and carrier rotatable bodies are rotatable independently of each other between said operative and inoperative positions thereof; and rotatable body biasing means for biasing said unit and carrier rotatable bodies when said rotatable bodies are rotated independently of each other, such that said rotatable bodies are moved away from each other when a distance between said rotatable bodies is greater than a predetermined distance and toward each other when said distance is smaller than said predetermined distance, wherein said positioning means comprises means for positioning said image forming unit relative to said image carrier when said unit rotatable body is rotated between said operative and inoperative positions and guide means for guiding at least one of said developing and cleaning devices to rotate about said means for pivotally supporting such that said image forming unit does not interfere with said image carrier.

6. An image forming apparatus as claimed in claim 5, wherein said rotatable body biasing means comprises a toggle spring.

7. In an image forming apparatus having at least a housing, an image carrier in said housing for carrying an electrostatic latent image thereon, a developing device for developing said latent image to produce a visible image, and a cleaning device for removing a developer, a combination comprising:

a unit rotatable body rotatably supported relative to said housing for movement between an operative position and an inoperative position;

means for pivotally supporting said developing and cleaning devices on said unit rotatable body, wherein said developing and cleaning devices together comprise an image forming unit;

positioning means for positively rotating said developing and cleaning devices relative to one another when said unit rotatable body is rotated between said operative and inoperative positions; and a carrier rotatable body rotatably supported relative to said housing of said image forming apparatus between an operative position and an inoperative position, and detachably supporting said image carrier, wherein said positioning means comprises means for positioning said image forming unit relative to said image carrier when said unit rotatable body is rotated between said operative and inoperative positions and guide means for guiding at least one of said developing and cleaning devices to rotate about said means for pivotally supporting such that said image forming unit does not interfere with said image carrier, wherein said guide means comprises cam means provided in said carrier rotatable body and follower means provided in at least one of said developing and cleaning devices, and wherein said cam means comprises a first cam surface defined by at least one of opposite side plates which form a part of said carrier rotatable body, a second cam surface defined by at least one movable member and extending parallel to said first cam surface, a support member rotatably supporting one end of said movable member, movable member biasing means for biasing said movable member such that said second cam surface normally remains parallel to said first cam surface, and at least one pin provided in at least one of said developing and cleaning devices and positioned so as to be guided by said first and second cam surfaces.

* * * * *